US012767477B2

(12) United States Patent
Yoshikawa

(10) Patent No.: US 12,767,477 B2
(45) Date of Patent: Oct. 20, 2026

(54) SHEET DISCHARGING APPARATUS AND IMAGE FORMING APPARATUS

(71) Applicant: CANON KABUSHIKI KAISHA, Tokyo (JP)

(72) Inventor: Takuro Yoshikawa, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 85 days.

(21) Appl. No.: 18/625,287

(22) Filed: Apr. 3, 2024

(65) Prior Publication Data

US 2024/0343512 A1 Oct. 17, 2024

(30) Foreign Application Priority Data

Apr. 13, 2023 (JP) ..... 2023-065566
Mar. 5, 2024 (JP) ..... 2024-033163

(51) Int. Cl.
*B65H 29/70* (2006.01)
*B65H 29/14* (2006.01)

(52) U.S. Cl.
CPC ..... *B65H 29/70* (2013.01); *B65H 29/14* (2013.01); *B65H 2404/1431* (2013.01); *B65H 2404/144* (2013.01); *B65H 2404/152* (2013.01); *B65H 2801/06* (2013.01)

(58) Field of Classification Search
CPC . B65H 29/14; B65H 29/70; B65H 2404/1431
See application file for complete search history.

(56) References Cited

U.S. PATENT DOCUMENTS 8,360,426 B2 * 1/2013 Arikawa ..... G03G 15/2064 271/274
8,998,196 B2 * 4/2015 Tsuda ..... B65H 5/062 271/188
9,073,722 B2 * 7/2015 Uehara ..... B65H 29/12
9,395,671 B1 * 7/2016 Yano ..... G03G 15/6573
10,289,067 B2 * 5/2019 Enomoto ..... G03G 15/6552

FOREIGN PATENT DOCUMENTS

JP 60252556 A * 12/1985
JP H08127453 A 5/1996
JP H09169463 A 6/1997
JP 2000327198 A 11/2000
JP 2002087675 A 3/2002

* cited by examiner

*Primary Examiner* — Patrick Cicchino
(74) *Attorney, Agent, or Firm* — ROSSI, KIMMS & McDOWELL LLP

(57) ABSTRACT

A sheet discharging apparatus includes a first support shaft, a first roller supported by the first support shaft, a second support shaft, a second roller supported by the second support shaft and including a first outer surface, a holder member including a supporting portion configured to support the second support shaft, and a rotating portion that includes a second outer surface having a diameter smaller than a diameter of the first outer surface and greater than a diameter of the second support shaft and that is configured to rotate integrally with the second roller. At least a portion of the second outer surface is positioned closer to the supporting portion than a middle point between the second roller and the supporting portion in the axial direction. An uppermost position of the second outer surface is higher than an uppermost position of the supporting portion.

20 Claims, 5 Drawing Sheets

SHEET DISCHARGING APPARATUS AND IMAGE FORMING APPARATUS

BACKGROUND OF THE INVENTION

Field of the Invention

The present invention relates to a sheet discharging apparatus for discharging sheets, and an image forming apparatus for forming images on sheets.

Description of the Related Art

Image forming apparatuses such as printers, copying machines, facsimiles, and multifunction devices having such functions are equipped with a sheet discharging apparatus for discharging sheets on which images have been formed. Japanese Patent Application Laid-Open Publication No. H08-127453 proposes a sheet discharging apparatus in which rollers for providing appropriate stiffness as a wavy shape on a sheet are disposed between a plurality of sheet discharge roller pairs that are arranged along a sheet width direction. Japanese Patent Application Laid-Open Publication No. 2000-327198 proposes a configuration in which a flange portion having a greater diameter than an outer diameter of a roller is disposed on both sides of a roller that constitutes one of rollers of a discharge roller pair that kicks out a trailing edge of the sheet. Japanese Patent Application Laid-Open Publication No. 2002-87675 proposes a configuration in which a shaft of a discharge roller that constitutes one of the rollers of the sheet discharge roller pair is supported by a roller holder, and the discharge roller is pressed against the sheet discharge roller by a coil spring.

In a case where a so-called tabbed sheet, in which a projected portion such as a tab is formed on a sheet body, is discharged by the sheet discharging apparatus, normal discharge of sheets may be obstructed by the tab, or projected portion, coming into contact with a part of the apparatus other than the roller.

SUMMARY OF THE INVENTION

The present invention provides a sheet discharging apparatus and an image forming apparatus that can improve sheet discharging property.

According to an aspect of the invention, a sheet discharging apparatus includes a first support shaft, a first roller supported by the first support shaft and configured to rotate, a second support shaft, a second roller that is configured to nip and discharge the sheet together with the first roller, that is supported by the second support shaft, that includes a first outer surface configured to abut against the first roller, and that is arranged to come into contact with a lower surface of the sheet being discharged, a holder member including a supporting portion configured to support the second support shaft at a position separated from the second roller in an axial direction of the second support shaft, the holder member being movable such that the second support shaft moves toward and away from the first support shaft, and a rotating portion that is supported by the second support shaft, that includes a second outer surface having a diameter smaller than a diameter of the first outer surface and greater than a diameter of the second support shaft, and that is configured to rotate integrally with the second roller, wherein the rotating portion is arranged between the second roller and the supporting portion in the axial direction, wherein at least a portion of the second outer surface is positioned closer to the supporting portion than a middle point between the second roller and the supporting portion in the axial direction, and wherein an uppermost position of the second outer surface is higher than an uppermost position of the supporting portion.

According to another aspect of the invention, a sheet discharging apparatus includes a first support shaft, a first roller supported by the first support shaft and configured to rotate, a second support shaft, a second roller that is configured to nip and discharge the sheet together with the first roller, that is supported by the second support shaft, that includes a first outer surface configured to abut against the first roller, and that is arranged to come into contact with a lower surface of the sheet being discharged, a supporting portion configured to support the second support shaft at a position separated from the second roller in an axial direction of the second support shaft, the supporting portion being configured not to rotate integrally with the second roller, and a rotating portion that is supported by the second support shaft, that includes a second outer surface having a diameter smaller than a diameter of the first outer surface and greater than a diameter of the second support shaft, and that is configured to rotate integrally with the second roller, wherein the rotating portion is arranged between the second roller and the supporting portion in the axial direction, wherein at least a portion of the second outer surface is positioned closer to the supporting portion than a middle point between the second roller and the supporting portion in the axial direction, and wherein an uppermost position of the second outer surface is higher than an uppermost position of the supporting portion.

Further features of the present invention will become apparent from the following description of exemplary embodiments with reference to the attached drawings.

DESCRIPTION OF THE EMBODIMENTS

Figure 1:
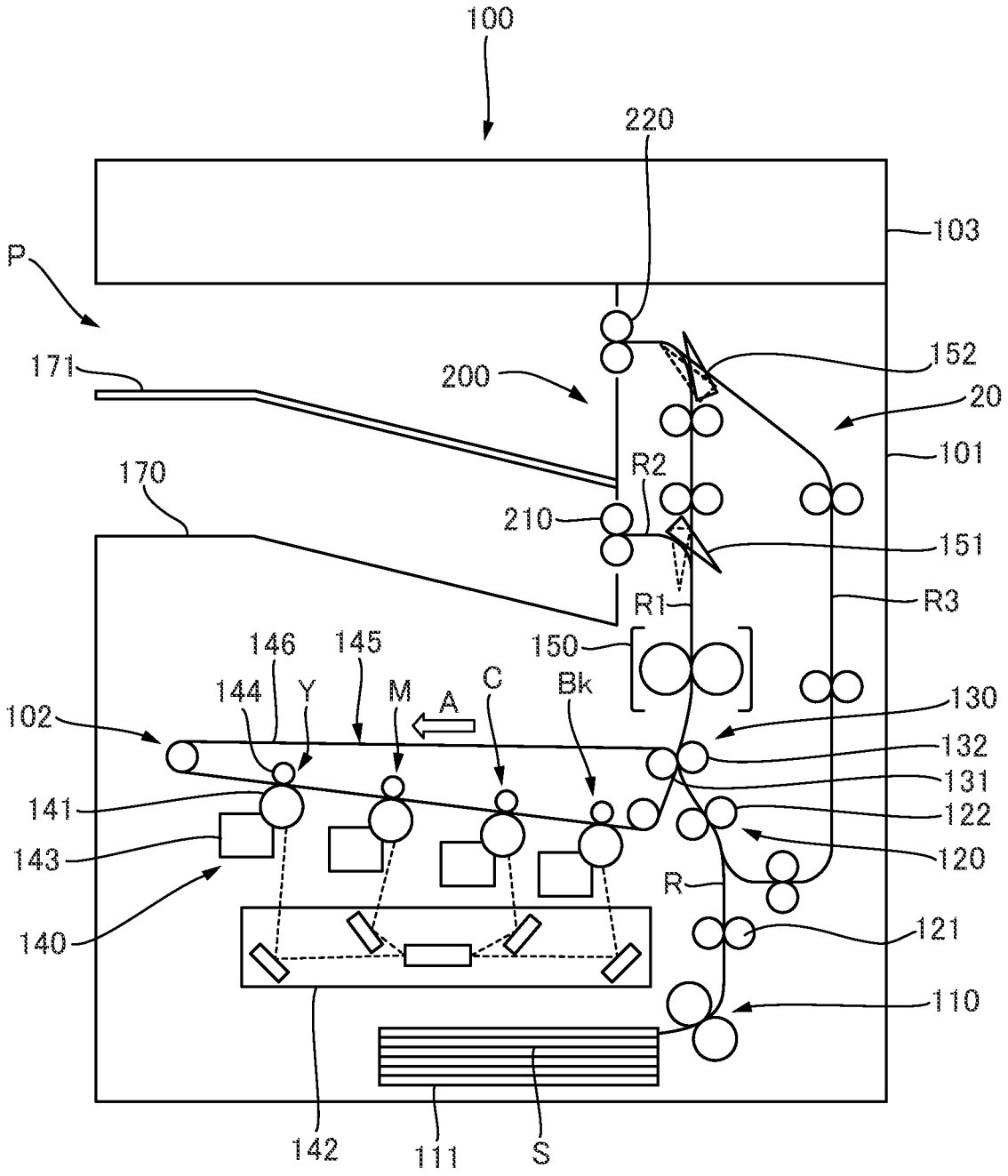
FIG. 1 is a schematic cross-sectional view illustrating a printer according to an embodiment.

An embodiment of the present disclosure will be described in detail with reference to the drawings. FIG. 1 is a view illustrating a general configuration of a laser beam printer, which is an example of an image forming apparatus according to the present embodiment. In FIG. 1, reference number 100 denotes a laser beam printer (hereinafter referred to as printer), 101 denotes a printer body serving as an apparatus body of an image forming apparatus, and 102 denotes an image forming unit for forming images on sheets. Reference number 103 denotes an image reading apparatus that is disposed approximately horizontally on an upper portion of the printer body 101, and a sheet discharge space P for discharging sheets is formed between the image reading apparatus 103 and the printer body 101. The printer body 101 includes a sheet feeding unit 110 for feeding sheets S from a sheet feed cassette 111, and a reverse conveyance portion 20 for conveying the sheet to which an image has been formed on a first surface again to the image forming unit 102.

The image forming unit 102 includes a scanner unit 142, and four process cartridges 140 for forming toner images of four colors, which are yellow (Y), magenta (M), cyan (C), and black (Bk). Each process cartridge 140 is equipped with a photosensitive drum 141 and a developing unit 143. Further, the image forming unit 102 is equipped with an intermediate transfer unit 145 arranged above the process cartridges 140.

The intermediate transfer unit 145 is equipped with an intermediate transfer belt 146 wound around a secondary transfer inner roller 131 and the like. Further, the intermediate transfer unit 145 includes primary transfer rollers 144 disposed on an inner side of the intermediate transfer belt 146 and abutting against the intermediate transfer belt 146 at positions opposed to the respective photosensitive drums 141. The intermediate transfer belt 146 is arranged to be in contact with each of the photosensitive drums 141, and is driven by a driving unit not shown to rotate in the direction of arrow A. By having a transfer bias of positive polarity applied to the intermediate transfer belt 146 by the primary transfer rollers 144, the toner images of respective colors having negative polarity formed on the photosensitive drums 141 are sequentially transferred in multiple layers to the intermediate transfer belt 146. Thereby, a full-color image is formed on the intermediate transfer belt.

Further, a secondary transfer roller 132 that constitutes a secondary transfer portion 130 for transferring the full-color image formed on the intermediate transfer belt to the sheet S is disposed at a position opposed to the secondary transfer inner roller 131 of the intermediate transfer unit 145. Moreover, a fixing unit 150 is arranged above the secondary transfer roller 132, and a sheet discharge portion 200 serving as a sheet discharging apparatus is arranged downstream in a sheet conveyance direction of the fixing unit 150. In the sheet discharge portion 200, which will be described in detail later, a first discharge roller pair 210 and a second discharge roller pair 220 serving as rotary member pairs are disposed. As described later in the section titled "Configuration of Sheet Discharge Portion", the sheet discharge portion 200 of the present embodiment includes a plurality of second discharge roller pairs 220 that are aligned in the sheet width direction. Each of the second discharge roller pairs 220 has the same function in that they discharge sheets S. Accordingly, "the second discharge roller pair 220" in the present section and the following section "Image Forming Operation" refers to an arbitrary one of the plurality of second discharge roller pairs 220. The same applies for the first discharge roller pair 210.

Further, in FIG. 1, R denotes a first sheet conveyance path for conveying sheets fed from the sheet feeding unit 110 to the image forming unit 102, and R1 denotes a second sheet conveyance path for conveying sheets on which an image has been formed in the image forming unit 102. R2 denotes a sheet discharge path branched from the second sheet conveyance path R1, and the first discharge roller pair 210 is disposed in the sheet discharge path R2. R3 denotes a reconveyance path disposed in the reverse conveyance portion 20 through which the first sheet conveyance path R and the second sheet conveyance path R1 are communicated.

Image Forming Operation

Next, an image forming operation of a printer 100 configured as above will be described. When the image forming operation is started, at first, laser light is irradiated from the scanner unit 142 based on an image information from a personal computer and the like not shown. Then, the surfaces of the photosensitive drums 141 charged uniformly to a predetermined polarity and potential are sequentially exposed by the laser light, and electrostatic latent images are formed on the photosensitive drums. Thereafter, the electrostatic latent images are developed by using toner and visualized. Then, the respective toner images of four colors, which are yellow (Y), magenta (M), cyan (C), and black (Bk), on the photosensitive drums 141 are transferred to the intermediate transfer belt 146 by transfer bias applied to the primary transfer rollers 144, and a full-color toner image is formed on the intermediate transfer belt. The toner remaining on the photosensitive drums 141 are collected by a cleaning unit not shown disposed in the process cartridge 140 into a waste toner container not shown. In parallel with the toner image forming operation, the sheet S stored in the sheet feed cassette 111 is sent out by the sheet feeding unit 110, and thereafter, the sheet S is conveyed by a conveyance roller pair 121 to a skewing correction unit 120, and skewing is corrected by the skewing correction unit 120. Next, a conveyance roller pair 122 disposed in the skewing correction unit 120 rotates such that a leading edge of the sheet S whose skewing has been corrected corresponds to a position of the full-color toner image on the intermediate transfer belt by the secondary transfer portion 130, and the sheet S is conveyed to the secondary transfer portion 130. Then, the full-color toner image is transferred collectively onto the sheet S by secondary transfer bias applied to the secondary transfer roller 132 at the secondary transfer portion 130.

Next, the sheet S to which the full-color toner image has been transferred is conveyed to the fixing unit 150, and the toner image on the sheet S is fixed as a full-color image by having the toner of respective colors being melted and mixed by being heated and pressed by the fixing unit 150. Thereafter, the sheet S to which the toner image has been fixed is discharged, for example by the first discharge roller pair 210 disposed in the sheet discharge path R2 onto a sheet discharge tray 170 disposed at a bottom of the sheet discharge space P. If the sheet discharge tray 171 is selected as a sheet discharge destination, a switching member 151 is moved from a second position illustrated by a solid line for guiding the sheet toward the first discharge roller pair 210 to a first position illustrated by a broken line for guiding the sheet to the reverse conveyance portion 20. Then, the sheet is discharged by the second discharge roller pair 220 onto the sheet discharge tray 171 disposed in the sheet discharge space P.

When forming images on both sides of a sheet, the switching member 151 is moved from the second position to the first position. Thereby, the sheet on which an image has been formed on a first surface reaches the second discharge roller pair 220 which also serves as the reverse conveyance portion 20 that can be rotated both in normal and reverse directions disposed on the second sheet conveyance path R1. Thereafter, a switching member 152 is moved from a third position illustrated by a solid line for guiding the sheet toward the second discharge roller pair 220 to a fourth position illustrated by a broken line for guiding the sheet toward a reconveyance path R3 of the reverse conveyance portion 20. Then, by rotating the second discharge roller pair 220 in a reverse direction, the sheet is conveyed to the reconveyance path R3 in a reversed state. Thereafter, the sheet is reconveyed through the reconveyance path R3 to the secondary transfer portion 130, and an image is formed on a second surface that is opposite to the first surface.

Then, after a toner image has been fixed to the sheet again at the fixing unit 150, the sheet S on which images has been formed on both surfaces is discharged by the first discharge roller pair 210 onto the sheet discharge tray 170. Alternatively, the switching member 151 is moved to the first position, and the sheet is discharged by the second discharge roller pair 220 onto the sheet discharge tray 171 disposed in the sheet discharge space P.

Configuration of Sheet Discharge Portion

Figure 2:
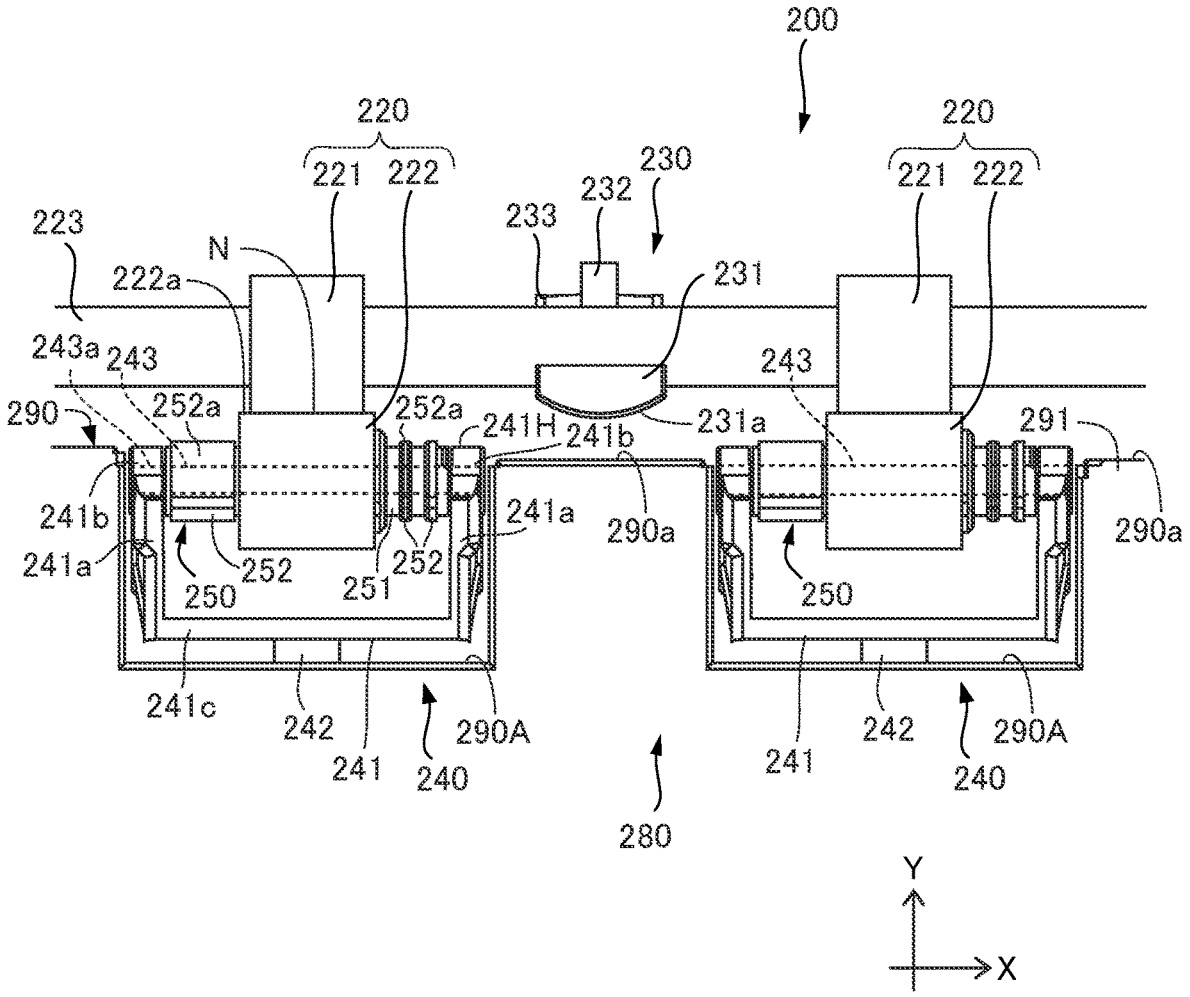
FIG. 2 is a side view illustrating a sheet discharge portion according to the embodiment.

Next, a configuration of the sheet discharge portion 200 serving as a sheet discharging apparatus provided in the printer 100 will be described with reference to FIG. 2. FIG. 2 is a side view illustrating a sheet discharge portion 200 according to the present embodiment. FIG. 2 illustrates only the portion having the second discharge roller pairs 220 of the sheet discharge portion 200 from the side on which the sheet discharge tray 171 is provided. Further, according to the present embodiment, the first discharge roller pair 210 adopts a similar configuration as the second discharge roller pair 220. Therefore only the second discharge roller pair 220 is illustrated as an example, and the description of the first discharge roller pair 210 is omitted.

As illustrated in FIG. 2, in the sheet discharge portion 200, a plurality of second discharge roller pairs 220 serving as a plurality of rotary member pairs are aligned in an axial direction X, which is a sheet width direction orthogonal to a sheet discharge direction and an up-down direction Y. In the present embodiment, the up-down direction Y is a direction orthogonal to both the sheet discharge direction by the second discharge roller pair 220 and the axial direction X.

Each second discharge roller pair 220 includes a drive roller 221 serving as a first roller, i.e., first rotating portion, and a follower roller 222 serving as a second roller, i.e., second rotating portion. The axial direction X is a rotational axis direction of the follower roller 222. The follower roller 222 is configured to come into contact with a lower surface of the sheet S being discharged, and to nip and discharge the sheet S together with the drive roller 221. One pair of the drive roller 221 and the follower roller 222 that are abutted against each other (for example, the second discharge roller pair 220 on the left side of FIG. 2) can be referred to as a first roller pair. In this case, another pair of the drive roller 221 and the follower roller 222 (for example, the second discharge roller pair 220 on the right side of FIG. 2) disposed at a separated position from the first roller pair in the axial direction X may be referred to as a second roller pair that nips and discharges the sheet S together with the first roller pair.

An upper frame not shown is fixed to the printer body 101, and a drive shaft 223 serving as a first support shaft is supported rotatably on the upper frame. The drive roller 221 is fixed to and supported by the drive shaft 223, and the drive shaft 223 is driven to rotate by a drive motor not shown.

The sheet discharge portion 200 further includes outer diameter portions 252 serving as a rotating portion, i.e., third rotating portion. The outer diameter portions 252 according to the present embodiment are a part of a roller holding shaft 250 that holds the follower roller 222. The outer diameter portions 252 have an outer diameter surface 252*a*, i.e., second outer surface, having a diameter that is smaller than a diameter of an outer diameter surface 222*a*, i.e., first outer surface, of the follower roller 222 and greater than a diameter of a support shaft 243, i.e., second support shaft, described below. The outer diameter portions 252 rotate integrally with the follower roller 222, i.e., second roller. The details of the roller holding shaft 250 and the outer diameter portions 252 will be described below.

Meanwhile, the printer body 101 includes, on the lower side of the drive roller 221, mainly a lower frame 290 fixed to and supported by the printer body 101, and a holder mechanism 240 serving as a support mechanism supported by the lower frame 290. That is, the lower frame 290 has a plurality of frame recessed portions 290A formed thereto, and in each of the frame recessed portions 290A is arranged the holder mechanism 240 in a manner supported by the lower frame 290. The holder mechanism 240 includes a holder member 241, the support shaft 243 serving as a second support shaft, and a coil spring 242 serving as a first urging member. That is, a support structure 280 including the holder member 241 may be referred to as a structure that supports the support shaft 243. Further, the holder mechanism 240 is arranged within a range through which a maximum-sized sheet may pass. The maximum size is the maximum among sheet sizes conveyable by the printer 100, that is, among sizes of sheets that the sheet discharge portion 200 can discharge.

The support shaft 243 is arranged below the drive shaft 223. The support shaft 243 is fixed to and supported by the holder member 241. The holder member 241 is pivotably supported on the printer body 101 about a pivot fulcrum not shown arranged at a depth side in the drawing, that is, upstream side in the sheet conveyance direction. The holder member 241 is movable such that the support shaft 243 moves toward and away from (i.e., in an approaching and separating direction with respect to) the drive shaft 223. That is, the holder member 241 is supported in the printer body 101 such that the support shaft 243 may move in a direction moving the follower roller 222 toward and away from the drive roller 221, while keeping the support shaft 243 in a posture parallel to the axial direction with respect to the drive shaft 223. The coil spring 242 urges the holder member 241 such that the follower roller 222 is pressed against the drive roller 221 through the support shaft 243. That is, the holder member 241 receives an urging force from the coil spring 242 in a direction urging an end supporting portion 241*b* upward.

Specifically, the holder member 241 includes a base portion 241*c* that is supported pivotably with respect to the lower frame 290, side wall portions 241*a* that extend upward from both ends in the axial direction of the base portion 241*c*, and end supporting portions 241*b* disposed at upper ends of the side wall portions 241*a*. Both ends of the support shaft 243 that rotatably support the roller holding shaft 250 and the follower roller 222 integrally fixed thereto are fixed to and supported by the end supporting portions 241*b* in a manner embedded thereto. In other words, the end supporting portions 241*b* support the support shaft 243 in a manner covering the entire circumference of an outer diameter surface 243*a* of the support shaft 243. Therefore, for example, even when the follower roller 222 is separated from the drive roller 221, the support shaft 243 and the follower roller 222 are prevented from falling off from the holder member 241.

An example in which the end supporting portion 241*b* covers the entire circumference of the outer diameter surface 243*a* of the support shaft 243 has been illustrated. However, another arrangement may be adopted to suppress the support shaft 243 from being detached upward from the end supporting portion 241*b* by the end supporting portion 241*b* being in contact with not only the lower portion but also to at least a part of the upper portion of the support shaft 243.

For example, an arrangement may be adopted in which a part of the end supporting portion is cut at an upper portion of the support shaft 243 such that the shape of the end supporting portion is not continuous in the circumferential direction.

The roller holding shaft 250 is formed in a hollow shaft shape. The support shaft 243 is inserted through the inner side of the holding shaft 250, such that the roller holding shaft 250 and the follower roller 222 are supported rotatably by the support shaft 243. The outer diameter surface 243*a* serving as a third outer diameter surface, i.e., third outer surface, of the support shaft 243 is formed to have a smaller diameter than the outer diameter surfaces 252*a* serving as a second outer diameter surface, i.e., second outer surface, of the outer diameter portion 252 of the roller holding shaft 250, as described in detail below.

As described, the roller holding shaft 250 and the follower roller 222 are rotatably supported by the holder mechanism 240. By the urging force of the coil spring 242, the outer diameter surface 222*a* serving as a first outer diameter surface, i.e., first outer surface, of the follower roller 222 is pressed against the drive roller 221. Thereby, each of the second discharge roller pairs 220 forms a nip N between the drive roller 221 and the follower roller 222, and the sheet S nipped by the nip Nis conveyed and discharged toward the sheet discharge tray 171.

Further, an outer wall 291 is fixed to the side of the lower frame 290 having the sheet discharge space P (refer to FIG. 1). Normally, a plurality of sheets being discharged onto the sheet discharge tray 171 are aligned by the trailing edges of the discharged sheets being abutted against the side surface of the outer wall 291 on the side of the sheet discharge space P by its own weight due to the inclination of the sheet discharge tray 171.

Further, in the sheet discharge portion 200, a stiffness imparting portion 230 serving as a regulating portion is disposed between the plurality of second discharge roller pairs 220 in the axial direction X. The stiffness imparting portion 230 includes a regulation member 231, a coil spring 232 serving as a second urging member, and a regulating portion support mechanism 233. A regulation surface 231*a* having a curved surface shape that regulates a position of the sheet by abutting against the sheet is formed on the regulation member 231. The regulation member 231 is arranged between two second discharge roller pairs 220, which are the first and second roller pairs described above, arranged adjacent one another in the axial direction X, which is an example of a pressing member that presses the upper surface of the discharged sheet S downward.

Further, the regulating portion support mechanism 233 supports the regulation member 231 movably in the up-down direction Y, and the regulation member 231 is urged toward the direction of the sheet, that is, downward, by the coil spring 232. The regulation surface 231*a* of the regulation member 231 is protruded downward to a position lower than the nip N of the second discharge roller pair 220, i.e., the nip of the first roller pair and the nip of the second roller pair. Thereby, the sheet being conveyed by the second discharge roller pair 220 is moved in sliding motion by the regulation surface 231*a* of the stiffness imparting portion 230 while being pressed downward and the sheet is curved, such that stiffness is imparted on the sheet. Therefore, the curling of the sheets discharged onto the sheet discharge tray 171 may be reduced, and the stacking ability and aligning ability of the sheets discharged onto the sheet discharge tray 171 may be improved. Although not shown, the stiffness imparting portion 230 is similarly arranged between the plurality of second discharge roller pairs 220 in the axial direction X. Further, the regulation surface 231*a* has a curved surface shape, such that the sheet S slides against the regulation surface 231*a* during conveyance but scratch marks are not easily formed on the sheet S.

Details of Roller Holding Shaft

Figure 3:
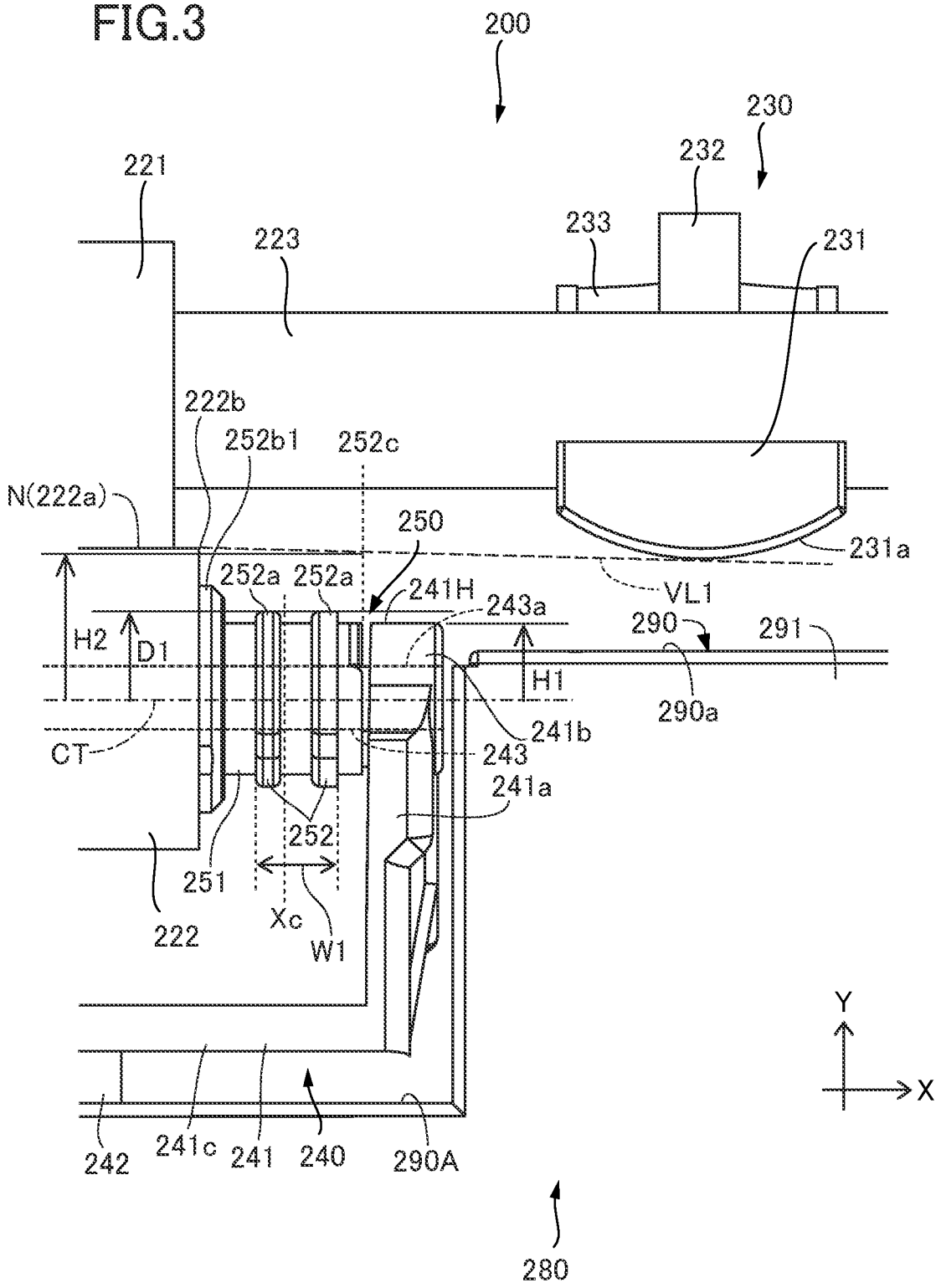
FIG. 3 is an enlarged side view illustrating positional relationships of parts in the sheet discharge portion according to the embodiment.

Next, the details of the roller holding shaft 250 will be described with reference to FIGS. 2 and 3. FIG. 3 is an enlarged side view illustrating the positional relationship of respective portions in the sheet discharge portion 200 according to the present embodiment.

As illustrated in FIGS. 2 and 3, the roller holding shaft 250 includes a shaft body 251 through an inner space of which the support shaft 243 described above is inserted, the outer diameter portions 252 formed on an outer circumference of the shaft body 251, and an attachment portion 252*b*. The outer diameter portions 252 are arranged on both sides of the follower roller 222 in the axial direction X. Further, the attachment portion 252*b* is arranged between one and the other outer diameter portions 252 in the axial direction X. The follower roller 222 is integrally fixed to the attachment portion 252*b*, that is, the roller holding shaft 250 rotates integrally with the follower roller 222. Since such a configuration is adopted, the outer diameter portions 252 serve as the outer diameter surfaces 252*a* that are exposed between the follower roller 222 and the holder member 241 of the holder mechanism 240 in the axial direction.

The roller holding shaft 250, i.e., the shaft body 251 and the outer diameter portions 252, and the holder member 241 are formed of an inelastic member, i.e., inelastic material or non-elastomeric material, that can be a resin material, such as polyoxymethylene (POM) resin. The follower roller 222 is formed of an elastic member, i.e., elastic material or elastomer, such as silicone rubber. The follower roller 222 is an elastic member that has a tubular shape so as to be attached to the attachment portion 252*b*, and the attachment portion 252*b* supports an inner circumference surface of the follower roller 222.

The attachment portion 252*b* includes a projected portion 252*b*1 that is projected toward the end supporting portion 241*b* of the holder member 241 than the end face of the follower roller 222 in the axial direction X (FIG. 3). The projected portion 252*b*1 is a portion exposed without being covered by the follower roller 222. The outer diameter portions 252, i.e., rotating portion, of the roller holding shaft 250 are protruded to be even closer to the end supporting portion 241*b* of the holder member 241, that is, protruded further toward the right side in FIG. 3, than the projected portion 252*b*1 in the axial direction X.

The projected portion 252*b*1 may be a flange portion that is protruded to an outer diameter side of a cylindrical surface of the attachment portion 252*b* that supports the inner circumference surface of the follower roller 222. In this case, by providing the flange-shaped projected portion 252*b*1 at one end of the attachment portion 252*b* in the axial direction X and inserting the follower roller 222 from the other end side in the axial direction X until the follower roller 222 abuts against the projected portion 252*b*1, the attachment of the follower roller 222 may be facilitated.

Further according to the present embodiment, the outer diameter portions 252 are formed to have a hole, or a recessed portion, such that a part of the shaft body 251 is exposed, but the present technique is not limited thereto, and the outer diameter portions 252 may be formed to cover the entire circumference.

Positional Relationship of Respective Portions

The state of the sheet discharge portion 200 illustrated in FIG. 3 is a state in which the holder member 241 is urged by the coil spring 242 described above and the follower roller 222 is in pressure contact with the drive roller 221. The following description illustrates the positional relationship of the respective portions in this state. An end portion 241H closest to the drive shaft 223 in the end supporting portion 241*b* of the holder member 241 has a height H1 in the outer diameter direction from a center CT of the support shaft 243 that supports the roller holding shaft 250 and the follower roller 222. The height H1 is a height by which the end portion 241H of the end supporting portion 241*b* protrudes higher than an upper surface 290*a*, i.e., upper end of the outer wall 291, which is the surface of the lower frame 290 closest to the drive shaft 223.

The outer diameter surfaces 252*a* of the outer diameter portions 252 of the roller holding shaft 250 are formed to have an outer diameter D1 from the center CT of the support shaft 243. The outer diameter D1 is smaller than the diameter of the outer diameter surface 222*a* of the follower roller 222, greater than the outer diameter surface 243*a* of the support shaft 243, and greater than the height H1. That is, the outer diameter surfaces 252*a* closest to the drive shaft 223 is positioned higher than and closer to the drive shaft 223 than the end portion 241H of the end supporting portion 241*b* that is closest to the drive shaft 223.

The outer diameter portions 252 of the roller holding shaft 250 are arranged between the follower roller 222, i.e., second roller, and the end supporting portion 241*b* that are arranged in a manner separated from each other in the axial direction X. Further, the uppermost position, i.e., end position in the Y direction, of the outer diameter surfaces 252*a*, i.e., second outer surface, of the outer diameter portions 252 is higher than the uppermost position, i.e., end position in the Y direction, of the end supporting portion 241*b*. Therefore, when tabbed sheets are discharged, as described below, the catching of tabs at the end supporting portion 241*b* may be reduced.

At least a part of the outer diameter surfaces 252*a* of the outer diameter portions 252 is positioned closer to the end supporting portion 241*b* of the holder member 241, i.e., right side of Xc in FIG. 3, than a middle point Xc between the follower roller 222 and the end supporting portion 241*b* of the holder member 241 in the axial direction X. Therefore, as described below, the catching of tabs at the end supporting portion 241*b* may be reduced more reliably.

In the present embodiment, another part of the outer diameter surfaces 252*a* of the outer diameter portions 252 is positioned closer to the follower roller 222, i.e., left side of Xc in FIG. 3, than the middle point Xc between the follower roller 222 and the end supporting portion 241*b* of the holder member 241 in the axial direction X. An entirety of the outer diameter surfaces 252*a* of the outer diameter portions 252 may be positioned closer to the end supporting portion 241*b* than the middle point Xc in the axial direction X.

A distance W1 from one end portion position of the outer diameter portions 252 in the axial direction X to the end portion position on the other side is referred to as a length of the outer diameter portions 252 in the axial direction X or an axial direction width of the outer diameter portions 252. The width of the outer diameter surfaces 252*a* of the outer diameter portions 252 in the axial direction X is preferably 4 mm or more. Not limited thereto, the length of the outer diameter portions 252 in the axial direction X is preferably longer than the length of the projected portion 252*b*1 (FIG. 3) mentioned above in the axial direction X. Thereby, catching of the tabs may be further reduced. More preferably, the length of the outer diameter portions 252 in the axial direction X is equal to or greater than one half of, or more preferably equal to or greater than two thirds of, the distance between the follower roller 222 and the end supporting portion 241*b* of the holder member 241 in the axial direction X.

The outer diameter portions 252 may also be formed such that the outer diameter surfaces 252*a* are a continuous surface, i.e., cylindrical surface, that is formed across the entire width in the axial direction X (refer to the outer diameter portion 252 on the left side of the follower roller 222 in FIG. 2). Further, the outer diameter portions 252 may be formed as a plurality of ring shaped members that are aligned along the axial direction X (refer to the outer diameter portions 252 on the right side of the follower roller 222 in FIG. 2).

In the present embodiment, the end supporting portion 241*b* of the holder member 241 and the outer diameter portions 252 of the roller holding shaft 250 are arranged on both sides of the follower roller 222 in the axial direction X. That is, in a case where the end supporting portion 241*b* illustrated in FIG. 3 is referred to as a first supporting portion, the sheet discharge portion 200 further includes a second supporting portion. The second supporting portion corresponds to the above-mentioned first supporting portion, and is arranged on an opposite side of the first supporting portion with respect to the follower roller 222, i.e., second roller, in the axial direction X (FIG. 2). Further, in a case where the outer diameter portions 252 illustrated in FIG. 3 is referred to as the rotating portion, the sheet discharge portion 200 further includes a second rotating portion. The second rotating portion corresponds to the above-mentioned rotating portion, and is arranged on an opposite side of the rotating portion with respect to the follower roller 222, i.e., second roller, in the axial direction X (FIG. 2). At least a part of the outer surface of the second rotating portion is positioned closer to the second supporting portion than a middle point between the second roller and the second supporting portion in the axial direction. Further, an uppermost position of the outer surface of the second rotating portion is higher than the uppermost position of the second supporting portion. Therefore, the catching of the tab at both sides of the follower roller 222, i.e., second roller, may be reduced.

It is assumed that a virtual line VL1 is drawn at a position where the nip N in the circumferential direction of the follower roller 222 is formed, which passes an end portion 222*b* of the follower roller 222 in the axial direction on the side having the stiffness imparting portion 230 and which is a tangential line that is tangent to the regulation surface 231*a*. The virtual line VL1 is a virtual straight line that is tangent to an upper end of the outer diameter surface 222*a* of the follower roller 222, i.e., first outer surface of the second roller, and the regulation surface 231*a* of the regulation member 231, i.e., lower surface of the pressing member, when the sheet discharge portion 200 is viewed from a downstream side in the sheet discharge direction. In this state, an end portion 252*c* in the axial direction of the roller holding shaft 250, i.e., outer diameter surfaces 252*a*, on the side having the stiffness imparting portion 230 is lower than a height H2 to the virtual line VL1. That is, the outer diameter D1 of the outer diameter surfaces 252*a* is set such that the outer diameter surfaces 252*a* is positioned more distant from the drive shaft 223 than the virtual line VL1. In other words, when the sheet discharge portion 200 is viewed from the downstream side in the sheet discharge direction, the outer diameter surfaces 252*a*, i.e., second outer surfaces of the rotating portion, are at a position below and separated from the virtual straight line (VL1) mentioned earlier.

Operation During Sheet Discharge

Figure 4B:
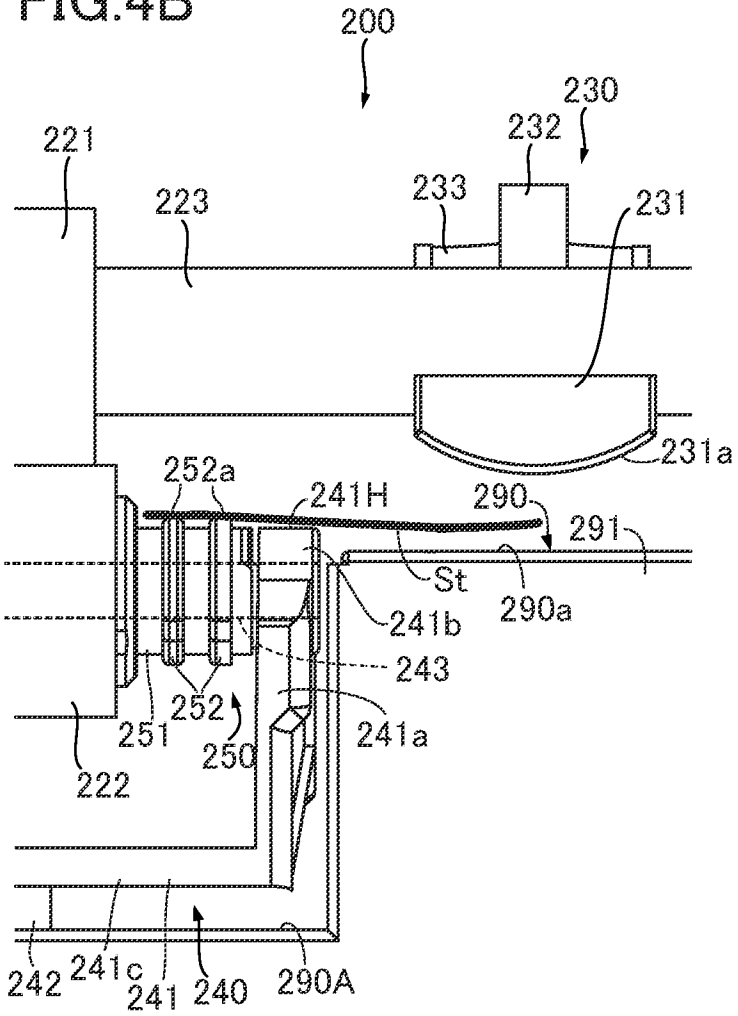
FIG. 4B is an enlarged side view illustrating a state in which a tab of a tabbed sheet is conveyed in the sheet discharge portion.
Figure 4A:
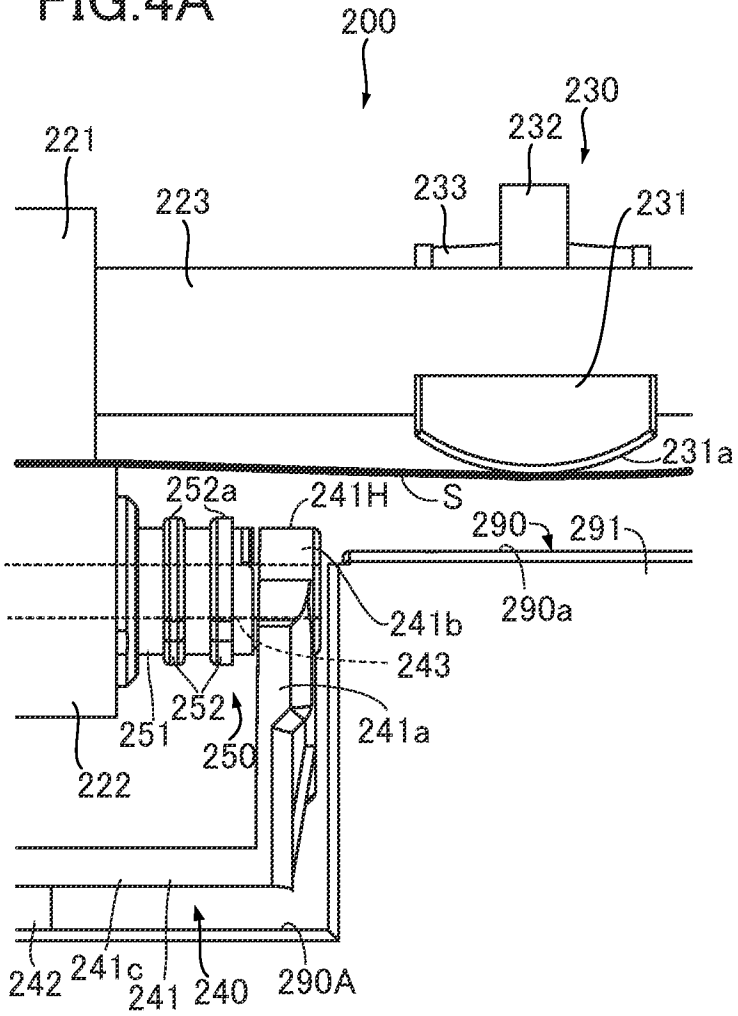
FIG. 4A is an enlarged side view illustrating a state in which a sheet body is conveyed in the sheet discharge portion.
Figure 5:
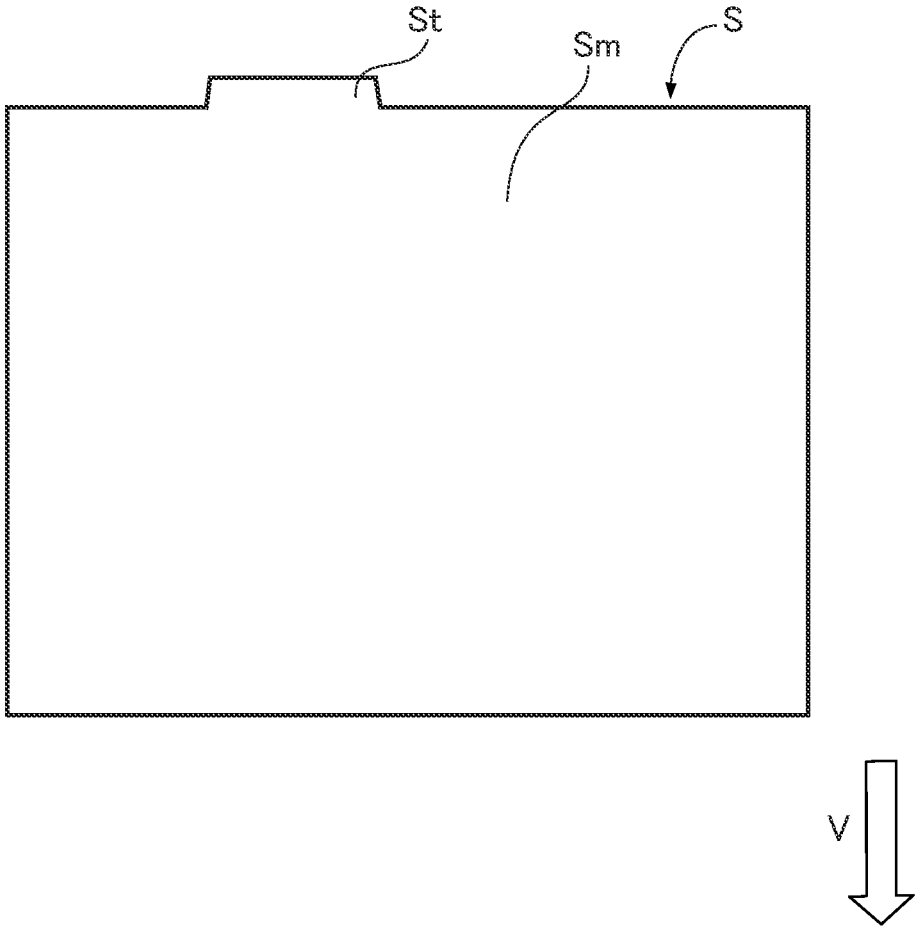
FIG. 5 is an explanatory view illustrating the tabbed sheet.

Next, a case of discharging a sheet S, which is a tabbed sheet, from the sheet discharge portion 200 will be described with reference to FIGS. 4A, 4B, and 5. FIG. 4A is an enlarged side view illustrating a state in which the sheet body is conveyed in the sheet discharge portion. FIG. 4B is an enlarged view illustrating a state in which a tab of the sheet is conveyed in the sheet discharge portion. FIG. 5 is an explanatory view illustrating a tabbed sheet.

As illustrated in FIG. 5, the sheet S being a tabbed sheet has a tab St formed on a side edge of a sheet body Sm. For example, in a state where the sheet S is conveyed in a conveyance direction V, the tab St is present on a trailing edge of the sheet S. A position in which the tab St is formed on the sheet S in FIG. 5 is merely an example, and the position of the tab differs according to the sheet. The trailing edge of the sheet S according to the present specification is more specifically illustrated as referring to a side edge on an upstream side in the conveyance direction V of the sheet body Sm.

In a case where the sheet S being a tabbed sheet is conveyed by the plurality of second discharge roller pairs 220 in the sheet discharge portion 200 and discharged onto the sheet discharge tray 171, at first, as illustrated in FIG. 4A, the sheet body Sm is conveyed by the plurality of second discharge roller pairs 220. In this state, the sheet body Sm is nipped by the nip N of each of the second discharge roller pairs 220 while being pressed by the regulation surface 231*a* of the stiffness imparting portion 230 toward a direction away from the drive shaft 223, by which the passing position of the sheet is regulated. In other words, the regulation surface 231*a* regulates the position of the sheet body Sm of the sheet S to a position more distant from the drive shaft 223 than the distance from the drive shaft 223 to the nip N. Thereby, the sheet body Sm is curved to have stiffness imparted thereto.

Further, in this state, the sheet body Sm is in contact with the second discharge roller pairs 220 and the stiffness imparting portion 230, but is conveyed without being in contact with the roller holding shaft 250 and the holder mechanism 240. As described above, the roller holding shaft 250 and the holder mechanism 240 are formed by an inelastic member, but since they are arranged below the virtual line VL1 (refer to FIG. 3) and do not come into contact with the sheet body Sm, there is little risk of the sheet body Sm sliding thereon and having a scratch mark formed thereon. Therefore, according to the sheet discharge portion 200 of the present embodiment, deterioration of quality of the sheet S on which image has been formed as a product may be prevented.

Thereafter, it is assumed that the sheet body Sm is further conveyed to be passed through the second discharge roller pairs 220 and the stiffness imparting portion 230, and as illustrated in FIG. 4B, and that the tab St of the sheet S is positioned between the plurality of second discharge roller pairs 220 in the axial direction. Then, the tab St drops both by its own weight and being pressed downward by the stiffness imparting portion 230. In this state, the tab St may come into contact with the roller holding shaft 250. However, since the outer diameter surfaces 252*a* of the roller holding shaft 250 are protruded higher than the end portion 241H of the holder mechanism 240 and the upper surface 290*a* of the lower frame 290, the tab St does not easily come into contact with the holder mechanism 240 or the lower frame 290. That is, the outer diameter portions 252, i.e., rotating portions, of the roller holding shaft 250 are arranged such that they may be in contact with the tab St of a tabbed sheet in a state where the tab St is not nipped by the second discharge roller pair 220, i.e., first and second rollers, and where a part of the tab is positioned between the follower roller 222, i.e., second roller, and the end supporting portion 241*b*, i.e., first supporting portion, in the axial direction X. Therefore, the tab St may be conveyed by the roller holding shaft 250 that rotates integrally with the follower roller 222 without being conveyed on the holder mechanism 240 or the lower frame 290 and being caught thereby. Therefore, according to the sheet discharge portion 200 of the present embodiment, the sheet S may be discharged correctly.

Comparison with Alternative Configurations

According to the configuration disclosed in Japanese Patent Application Laid-Open Publication No. H08-127453 described above, for example, when the tab St passes through a portion other than the portion having the plurality of discharge roller pairs, i.e., kick-out rollers, in the axial direction X, conveyance force may not be applied on the tab St and the tab St may be stopped above a component fixed to the apparatus body. Then, the sheet may not be discharged correctly from the sheet discharge portion and may not be positioned on the supporting portion.

According to the configuration disclosed in Japanese Patent Application Laid-Open Publication No. 2000-327198 described above, for example, when the tab St passes through a portion other than the portion having the plurality of discharge roller pairs, i.e., rollers, in the axial direction, conveyance force may be applied to the tab from the flange portion. However, according to Japanese Patent Application Laid-Open Publication No. 2000-327198, the flange portion is arranged at a high position where the flange portion intersects the nip line of the discharge roller pair, and the flange portion is pressed against the sheet to curve the sheet, such that scratch marks may be formed on the sheet body or the tab, and the quality of the product may be deteriorated.

According to the configuration disclosed in Japanese Patent Application Laid-Open Publication No. 2002-87675 described above, for example, when the tab St passes through a portion other than the plurality of discharge roller pairs, i.e., discharge rollers, in the axial direction, conveyance force may be applied on the tab St from the shaft of the discharge rollers. However, according to the configuration of Japanese Patent Application Laid-Open Publication No. 2002-87675, only the lower side of the shaft of the discharge rollers is pressed against a roller holder, such that the discharge rollers may fall off from the roller holder. Therefore, when the apparatus is actually manufactured as a product, a holding portion for holding the upper portion of the shaft will be provided on the roller holder to prevent the discharge rollers from falling off from the roller holder. Therefore, the tab St may ride on the holding portion and the sheet may not be correctly discharged from the sheet discharge portion to be placed on the supporting portion.

According to the present embodiment, the discharging ability of tabbed sheets may be improved while preventing the drawbacks described above.

Other Possible Modifications

According to the present embodiment described above, a configuration is adopted in which the follower roller 222 is disposed movably and in a manner pressed against the drive roller 221 by the holder mechanism 240. However, the present embodiment is not limited thereto, and a configuration may be adopted in which the drive roller 221 and the drive shaft 223 are arranged movably and in a manner pressed against the follower roller 222.

According further to the present embodiment, the stiffness imparting portion 230 is arranged between the plurality of first discharge roller pairs 210 or the plurality of second discharge roller pairs 220 in the axial direction, to thereby impart stiffness to the sheets. However, the present technique is not limited thereto, and the stiffness imparting portion 230 may be omitted.

The present embodiment illustrates a configuration in which the regulation member 231 in the stiffness imparting portion 230 is urged by the coil spring 232 such that the sheet S is pressed toward the side in which the follower roller 222 is disposed. However, the present technique is not limited thereto, and for example, a configuration may be adopted in which the regulation member 231 is fixed such that the regulation surface 231*a* is positioned slightly lower than the nip N. Further, the regulation member 231 may be composed of a roller having a greater diameter than the drive roller 221. In that case, the roller may either rotate integrally with the drive shaft 223 or rotate freely.

The present embodiment illustrates a configuration in which the roller holding shaft 250 and the holder mechanism 240 are composed of an inelastic member, such as resin, but the present technique is not limited thereto. Specifically, the outer diameter portions 252 of the roller holding shaft 250 may be formed of elastic members.

The present embodiment also illustrates a configuration in which the follower roller 222 and the roller holding shaft 250 are formed of different members and rotated integrally, but the present technique is not limited thereto, and they may be formed of an integrally molded member, for example, such that they are formed as a same member and has a similar shape.

The present embodiment illustrates a configuration in which the support shaft 243 is fixed to the end supporting portion 241*b* of the holder mechanism 240, and the roller holding shaft 250 and the follower roller 222 are relatively rotated with respect to the support shaft 243. However, the present technique is not limited thereto, and the roller holding shaft 250 and the support shaft 243 may be composed integrally. That is, a configuration may be adopted in which projected portions having the same diameter as the support shaft 243 are formed on both ends of the roller holding shaft 250, and the projected portions may be directly supported rotatably on the end supporting portion 241*b* as a support shaft. That is, the support shaft 243, i.e., second support shaft, may be supported rotatably on the end supporting portion 241*b*, i.e., first supporting portion, of the holder member 241 so as to rotate integrally with the follower roller 222, i.e., second roller, and the roller holding shaft 250, i.e., rotating portion.

Further, the present embodiment illustrates a configuration in which the end portion 241H of the holder mechanism 240 is at the uppermost position of the support structure 280 that is positioned above the upper surface 290*a* of the lower frame 290. However, alternatively, the upper surface 290*a* of the lower frame 290 may be at the uppermost position of the support structure 280 that is positioned above the end portion 241H of the holder mechanism 240. Even according to this configuration, the tab St may be conveyed if the outer diameter surfaces 252*a* of the roller holding shaft 250 are positioned above the upper surface 290*a* that is arranged within the area through which the sheet may pass. Thereby, it becomes possible to prevent the tab St from riding on the upper surface 290*a* and the sheet S from being discharged incorrectly.

The present embodiment illustrates a configuration in which the sheet is a tabbed sheet, but the present technique is not limited thereto, and the apparatus may discharge a sheet having a projected portion that is protruded in a projected shape in a planar direction from a rectangular sheet body.

As described, according to the present disclosure, the sheet discharging property may be improved.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2023-065566, filed on Apr. 13, 2023, and 2024-033163, filed on Mar. 5, 2024, which are hereby incorporated by reference herein in their entirety.

What is claimed is:

1. A sheet discharging apparatus comprising:
- a first shaft;
- a first roller supported by the first shaft and configured to rotate;
- a second shaft;
- a second roller that:
  - is configured to nip and discharge the sheet together with the first roller;
  - is supported by the second shaft;
  - includes a first outer surface configured to abut against the first roller; and
  - is arranged to come into contact with a lower surface of the sheet being discharged;
- a holder member that:
  - includes a first supporting portion supporting the second shaft at a position separated from the second roller in an axial direction of the second shaft; and
  - is movable such that the second shaft is movable toward and away from the first shaft; and
- a first rotating portion that:
  - is supported by the second shaft;
  - includes a second outer surface having a diameter smaller than a diameter of the first outer surface and greater than a diameter of the second shaft;
  - is configured to rotate integrally with the second roller; and
  - is arranged between the second roller and the first supporting portion in the axial direction,
- wherein at least a portion of the second outer surface is positioned closer to the first supporting portion than a middle point between the second roller and the first supporting portion in the axial direction, and
- wherein an uppermost position of the second outer surface is higher than an uppermost position of the first supporting portion.

2. The sheet discharging apparatus according to claim 1, wherein the second shaft is fixed with respect to the first supporting portion of the holder member and is movable with respect to the first shaft along with a movement of the holder member.

3. The sheet discharging apparatus according to claim 1, wherein the second shaft is supported rotatably by the first supporting portion such that the second shaft rotates integrally with the second roller and the first rotating portion.

4. The sheet discharging apparatus according to claim 1, further comprising an urging member that urges the holder member such that the second roller is pressed against the first roller.

5. The sheet discharging apparatus according to claim 1, wherein:

the first roller and the second roller constitute a first roller pair, and the sheet discharging apparatus further comprises a second roller pair that is arranged at a position separated from the first roller pair in the axial direction and that is configured to nip and discharge the sheet together with the first roller pair.

6. The sheet discharging apparatus according to claim 5, further comprising:

a regulation member that is arranged between the first roller pair and the second roller pair in the axial direction and that is configured to press an upper surface of the sheet being discharged by the first roller pair and the second roller pair downward, and wherein the regulation member includes a lower surface that extends downward to a position lower than a nip of the first roller pair and a nip of the second roller pair.

7. The sheet discharging apparatus according to claim 6, wherein, as viewed from a downstream side in a sheet discharge direction, the second outer surface of the first rotating portion is below and separated from a virtual straight line that is tangent to an upper end of the first outer surface of the second roller and the lower surface of the regulating member.

8. The sheet discharging apparatus according to claim 6, further comprising an urging member that urges the regulation member downward.

9. The sheet discharging apparatus according to claim 1, wherein:

the second roller is formed of an elastic material, and the first rotating portion is formed of an inelastic material.

10. The sheet discharging apparatus according to claim 1, wherein another portion of the second outer surface of the first rotating portion is positioned closer to the second roller than the middle point in the axial direction.

11. The sheet discharging apparatus according to claim 1, wherein a length of the first rotating portion in the axial direction is 4 mm or more.

12. The sheet discharging apparatus according to claim 1, wherein a length of the first rotating portion in the axial direction is one half or more of a distance between the second roller and the first supporting portion in the axial direction.

13. The sheet discharging apparatus according to claim 1, wherein:

the second roller is an elastic member having a tubular shape, the sheet discharging apparatus further comprises an attachment portion to which the second roller is attached and which supports an inner circumference surface of the second roller, the attachment portion includes a projected portion that is projected closer to the first supporting portion than the second roller in the axial direction, and the first rotating portion is positioned even closer to the first supporting portion than the projected portion in the axial direction.

14. The sheet discharging apparatus according to claim 13, wherein a length of the first rotating portion in the axial direction is longer than a length of the projected portion in the axial direction.

15. The sheet discharging apparatus according to claim 1, further comprising:

a second supporting portion that is arranged at an opposite side of the first supporting portion with respect to the second roller in the axial direction and that corresponds to the first supporting portion; and a second rotating portion that is arranged at an opposite side of the first rotating portion with respect to the second roller in the axial direction, wherein at least a portion of an outer surface of the second rotating portion is positioned closer to the second supporting portion than a middle point between the second roller and the second supporting portion in the axial direction, and wherein an uppermost position of the outer surface of the second rotating portion is higher than an uppermost position of the second supporting portion.

16. The sheet discharging apparatus according to claim 1, wherein the first rotating portion is configured to come into contact with a tabbed sheet in a state in which a tab of the tabbed sheet is not nipped by the first roller and the second roller and a portion of the tab is positioned between the second roller and the first supporting portion in the axial direction.

17. The sheet discharging apparatus according to claim 1, further comprising a sheet discharge tray on which a sheet having been discharged through a nip between the first roller and the second roller is supported.

18. The sheet discharging apparatus according to claim 1, wherein the first supporting portion is arranged within an area where a sheet having a maximum size passes, the maximum size being maximum among sizes of sheets in the axial direction that the sheet is dischargeable by the sheet discharging apparatus.

19. A sheet discharging apparatus comprising:

a first shaft;

a first roller supported by the first shaft and configured to rotate;

a second shaft;

a second roller that:

is configured to nip and discharge the sheet together with the first roller;

is supported by the second shaft;

includes a first outer surface configured to abut against the first roller; and is arranged to come into contact with a lower surface of the sheet being discharged;

a supporting portion that:

supports the second shaft at a position separated from the second roller in an axial direction of the second shaft; and does not rotate integrally with the second roller; and a rotating portion that:

is supported by the second shaft;

includes a second outer surface having a diameter smaller than a diameter of the first outer surface and greater than a diameter of the second shaft;

is configured to rotate integrally with the second roller; and is arranged between the second roller and the first support in the axial direction, wherein at least a portion of the second outer surface is positioned closer to the supporting portion than a middle point between the second roller and the supporting portion in the axial direction, and wherein an uppermost position of the second outer surface is higher than an uppermost position of the supporting portion.

20. An image forming apparatus comprising:

an image forming unit configured to form an image on a sheet; and the sheet discharging apparatus according to claim 1 configured to discharge the sheet on which the image has been formed by the image forming unit.

* * * * *